United States Patent [19]

Cross, Jr.

[11] 4,033,079

[45] July 5, 1977

[54] REPLACEMENT HOLD-DOWN CLIP FOR SUSPENDED-CEILING PANELS

[76] Inventor: Eason Cross, Jr., 2309 Glasgow Road, Alexandria, Va. 22307

[22] Filed: Jan. 30, 1975

[21] Appl. No.: 545,553

[52] U.S. Cl. ..... 52/99; 52/494; 52/365; 52/125; 403/17; 24/85 B

[51] Int. Cl.[2] ..... E04B 5/57

[58] Field of Search ..... 52/498, 499, 484, 760, 52/98, 99, 494; 403/17, 406

[56] References Cited

UNITED STATES PATENTS

| | | | |
|---|---|---|---|
| 1,891,512 | 12/1932 | Venzle | 52/484 X |
| 1,974,819 | 9/1934 | Koerner | 52/484 X |
| 2,059,483 | 11/1936 | Parsons | 52/489 |
| 2,174,145 | 9/1939 | Tummins | 52/492 |
| 3,226,781 | 1/1966 | Schnabel | 52/98 X |
| 3,329,387 | 7/1967 | Fischer | 52/484 X |
| 3,338,732 | 8/1967 | Holcomb | 117/129 X |
| 3,447,823 | 6/1969 | Gregoire | 52/760 |
| 3,475,869 | 11/1969 | Jahn | 52/484 X |
| 3,565,473 | 2/1971 | Kedel | 52/760 |

*Primary Examiner*—Andrew V. Kundrat
*Attorney, Agent, or Firm*—Griffin, Branigan and Butler

[57] ABSTRACT

A replacement hold-down clip permits a standard ceiling panel to be manipulated into position in a suspended-ceiling support grid. The replacement clip is attached to the edge of the ceiling panel and is equipped with an extending tab by which the panel can be manipulated into position from the finished side of the ceiling. As a panel is pulled into position, a spring gripping means on the clip engages a bulb portion of the suspended support grid, so that the panel is held in place. The manipulating tab is frangible on the finished side of the ceiling so that it can be broken off after installation.

12 Claims, 2 Drawing Figures

REPLACEMENT HOLD-DOWN CLIP FOR SUSPENDED-CEILING PANELS

BACKGROUND OF THE INVENTION

The invention relates to hold-down clips for standard ceiling panels utilized in suspended ceiling arrangements. In particular, it relates to a replacement hold-down clip which can be utilized by an operator from the finished side of the ceiling.

Suspended ceiling systems commonly in use utilize a suspended grid consisting of inverted T-shaped beam members. Panel sections are set within the grid with their peripheral edges supported by the base of the inverted T-shaped beams. One common method of holding the panels in place against uplifting is the use of a U-shaped spring clip which is snapped over the top of the inverted T. In this respect, the top of the T is provided with a bulb-like enlargement to engage the spring clip. In this manner the arms of the spring clip extend toward the base of the inverted T and serve to press the back of the panel edges against the T-base to thereby prevent "flutter" and reduce or eliminate air drafts past the ceiling panels. For this reason, hold-down clips are required in fire-rated ceiling construction set forth in standard building code and fire regulations through references to the Underwriters Laboratory tests.

One major drawback of the commonly used hold-down clips, as described above, is that they only can be applied from the back side of the suspended ceiling structure. Accordingly, during construction, the final panel to be set in place is necessarily void of hold-down means. In addition, in the event of a need for wiring, plumbing or other type of maintenance, it is frequently necessary to remove ceiling panels to provide repair access. The panels can easily be pushed up and removed from the finished side of the ceiling, thereby unseating the hold-down clips. Upon replacing the ceiling panels, however, there arises the problem of replacing the clips from the finished-side of the suspended ceiling structure. Thus, the ceiling panels often remain in an improper dangerous, and frequently illegally-installed condition, thereby voiding the fire-rating of the ceiling construction.

Hence, an improved hold-down clip for panels is needed which can be efficiently and easily installed from the finished side of a suspended ceiling structure; and it is an object of this invention to provide a ceiling panel hold-down clip which securely maintains a panel member in place.

It is another object to provide a ceiling panel hold-down clip which can be manipulated from the finished side of a suspended ceiling arrangement.

It is a further object to provide a ceiling panel hold-down clip which can be used as a replacement clip for panels which have been removed.

Still another object is to provide a ceiling panel hold-down clip which includes a break-away manipulating portion so that the installed clip is not visible from the finished side of the ceiling.

Yet another object is to provide a single piece hold-down clip.

SUMMARY OF THE INVENTION

In accordance with principles of this invention, the objects as set forth are attained by providing a hold-down clip structure including a spring gripping means for engaging an enlarged bulb portion of an inverted T-beam of a ceiling suspension grid. The clip also is equipped with a protruding prong situated along a vertical support portion of the clip so that it can be inserted into the edge of a panel member in order to secure a clip to the panel. A tab portion extends from the base of the clip through which an operator may manipulate the tab and the attached panel from the finished side of a suspended ceiling arrangement. This manipulating tab is connected to the main clip-body by a weakened separation joint so that, once the panel is set in position within the grid and fastened in place, the tab may be broken off. In this manner, the securing clip is substantially invisible from the finished side of the ceiling.

BRIEF DESCRIPTION OF THE DRAWINGS

The foregoing and other objects, features, and advantages of the invention will be apparent from the following more particular description of a preferred embodiment of the invention, as illustrated in the accompanying drawings in which like reference characters refer to the same parts throughout the different views. The drawings are not necessarily to scale, emphasis instead being placed on illustrating principles of the invention.

In the drawings.

DESCRIPTION OF A PREFERRED EMBODIMENT

Figure 1:
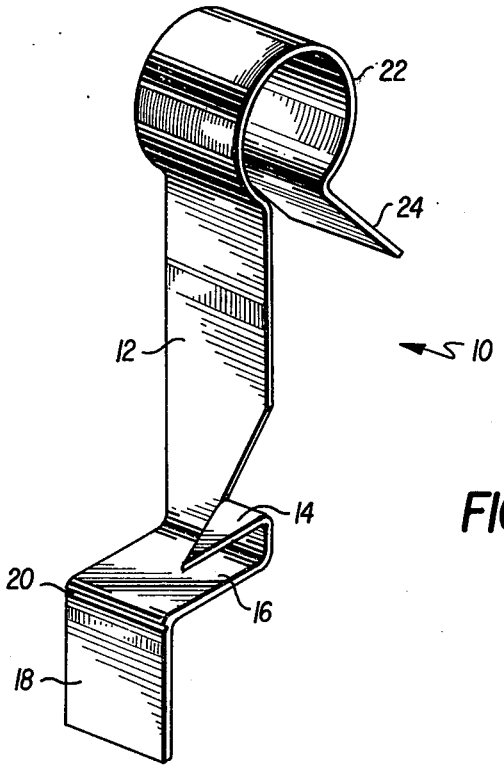
FIG. 1 is a perspective view of a hold-down clip for panels, according to the invention.

Referring to the elements of a preferred embodiment as illustrated in the drawings, numeral 10 generally represents a hold-down clip structure which comprises a main clip body and a frangible tab portion 18. A vertical support rib 12 connects a spring gripping means 22 to a horizontal support seat portion 16. A sharp prong 14 protrudes from the vertical rib 12 and is designed to be inserted into a peripheral edge of a ceiling panel. At the base of the hold-down clip the manipulating tab 18 is connected to the edge of support-seat 16. This extending tab is connected to the main clip body by a scored or otherwise weakened separation joint 20. The purpose of this weakened joint is to allow the extending tab to be broken away after the tab has been utilized to draw the panel member and the attached clip into secured position in a ceiling grid. The spring gripping means 22 is provided on the top of the clip to secure an attached panel in a properly seated position. In this respect, the clip 22 engages the bulb-like enlargement 32 on the top of an inverted T-suspension beam (See FIG. 2); and also has a locating ramp 24 affixed thereto for guiding the spring gripper onto the bulb enlargement.

Figure 2:
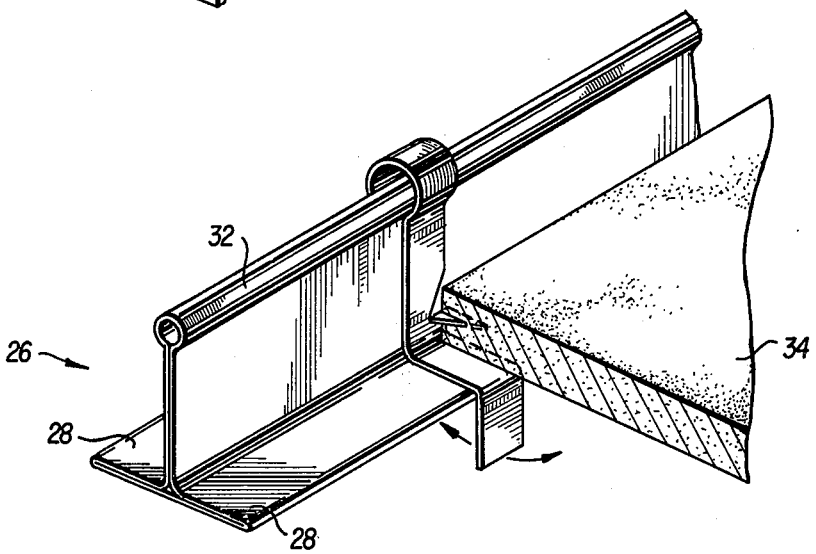
FIG. 2 is a perspective view of a section of standard suspended ceiling grid structure showing the hold-down clip in operative position.

FIG. 2 depicts a section of a suspended ceiling system and illustrates the hold-down clip in operation. The standard ceiling structure consists of a grid system made up of intersecting inverted T-shaped beams generally represented by numeral 26. Peripheral edges of ceiling panels 34 are designed to rest on the base-seat portions 28 of the inverted T-beams; and, as described above, the top of the inverted T has a bulb-like enlargement 32 to accommodate the clip's attachment.

In operation, the hold-down clip is attached to a peripheral edge of a ceiling panel by pressing the protruding prong 14 into the edge of the panel with the edge of the finished side of the panel resting against the horizontal seat-portion 16 of the clip. As many clips as are necessary to meet the ceiling construction Underwriters label rating are inserted at various selected points along the four sides of a panel. The panel then can be manipulated into position from its finished side by the operator grasping the extending tabs 18.

By pulling down on the extending tabs, the clip and the connected panel are drawn into seated position atop the base seat 28 of the inverted T-beams. As the panel is drawn down to its seat, gripping spring 22 is drawn over the bulb enlargement 32 of the beam; and the panel thereby is held in place as shown in FIG. 2. Once the panel is in seated position an operator can remove the extending manipulating tabs 18 by simply bending them along their weakened joints 20. Thus, the clip structure remains substantially invisible from the finished side of the ceiling.

While the invention has been particularly shown and described with reference to a preferred embodiment thereof, it will be understood by those skilled in the art that various alterations in form and detail may be made therein without departing from the spirit and scope of the invention. For example, means to engage the supporting beam structure could assume various different shapes. Additionally, means other than a pointed prong could be utilized to engage a ceiling panel. The specific design exhibited by the embodiment shown was chosen for reasons of production ease. In this respect, a preferred embodiment is stamped from a single piece of enamelled metal which is then bent, but the finished clips may be left plain or subsequently enamelled, as desired.

The embodiments of the invention in which an exclusive property or privilege is claimed are defined as follows:

1. A ceiling panel hold-down clip of the type in which a portion thereof engages a supporting beam, said clip comprising:

a vertical support rib;

releasable engaging means connected with said support rib at one end thereof for engaging said supporting beam;

securing means connected with said support rib for attachment to a panel; and manipulating means for manipulating an attached panel into a desired position with respect to said support beam, said manipulating means comprising a tab extending away from and substantially normal to the other end of said support rib, said tab having its terminal end bent such that the end portion of said tab extends downwardly away from the bottom surface of said ceiling panel when said securing means is attached to said panel thereby serving as a manipulating means for manipulating an attached panel into a desired position with respect to said support beam.

2. The hold-down clip of claim 1 wherein the extending tab is frangible, so that said end portion may be broken off after an attached panel is set in said desired position.

3. The hold-down clip of claim 1 wherein the securing means for attaching the hold-down clip to a panel member is a protruding prong.

4. The hold-down clip of claim 1 for use with a supporting beam structure of the type in which said supporting beam is in the shape of an inverted "T" having an enlarged bulb portion at the end of the vertical leg thereof and wherein said engaging means comprises a spring gripping member for gripping said enlarged bulb portion of said supporting beam.

5. The hold-down clip of claim 4 wherein the securing means for attaching the hold-down clip to a panel member is a protruding prong.

6. The hold-down clip of claim 4 including a locating ramp connected with said spring gripping member for guiding said spring gripping member onto said enlarged bulb portion of said supporting beam.

7. The hold-down clip of claim 6 wherein the securing means for attaching the hold-down clip to a panel member is a protruding prong.

8. The hold-down clip of claim 1 wherein said clip consists of only a single piece.

9. The hold-down clip of claim 1 wherein said clip is stamped from a single sheet of metal.

10. The hold-down clip of claim 9 wherein said clip is enamelled.

11. The hold-down clip of claim 6 wherein the extending tab is frangible, so that said end portion may be broken off after an attached panel is set in said desired position.

12. The hold-down clip of claim 4 wherein the extending tab is frangible, so that said end portion may be broken off after an attached panel is set in said desired position.

* * * * *